United States Patent [19]

Shanabarger

[11] 4,155,208

[45] May 22, 1979

[54] BUILDING INSULATION AND METHOD OF INSTALLATION

[76] Inventor: John A. Shanabarger, 273 E. Maple, Wabash, Ind. 46992

[21] Appl. No.: 910,694

[22] Filed: May 30, 1978

[51] Int. Cl.[2] ..... E04B 2/00; E04B 1/62

[52] U.S. Cl. ..... 52/406; 52/2; 52/743

[58] Field of Search ..... 52/2, 404, 406, 743

[56] References Cited

U.S. PATENT DOCUMENTS

| | | | |
|---|---|---|---|
| 2,749,262 | 6/1956 | Wiser | 52/406 |
| 2,777,786 | 1/1957 | Schwartz et al. | 52/406 |
| 2,906,655 | 9/1959 | Blumenstein | 52/406 |
| 2,934,465 | 4/1960 | Warp | 52/406 |
| 2,955,063 | 10/1960 | Driscoll | 52/406 |
| 3,300,910 | 1/1967 | Isaac | 52/2 |
| 3,328,926 | 7/1967 | Reinhard | 52/2 |
| 3,807,100 | 4/1974 | Kuss | 52/2 |

FOREIGN PATENT DOCUMENTS

| | | | |
|---|---|---|---|
| 2261866 | 7/1974 | Fed. Rep. of Germany | 52/2 |
| 2708733 | 9/1977 | Fed. Rep. of Germany | 52/743 |

*Primary Examiner*—J. Karl Bell

*Attorney, Agent, or Firm*—Gust, Irish, Jeffers & Rickert

[57] ABSTRACT

A building construction has an outer wall adjacently positioned to a plurality of vertical, transversely spaced parallel studs, each stud having a first side substantially parallel to and in adjacent proximity to the outer wall. The stud sides are substantially coplanar and each stud has a second side spaced inwardly from the wall, with the second sides being substantially coplanar. Insulating spaces are defined between adjacent studs and the planes of the first and second sides. A first plastic sheet which is substantially coextensive with the area defined by said first sides is adjacently supported to said first sides. A plurality of elongated plastic bags, each insertable between adjacent studs and each bag volumetrically expandable to substantially displace the space between adjacent studs, have elongated webs connecting adjacent bags with the webs being substantially coextensive with the second sides and contiguous therewith. A second plastic sheet, which is substantially coextensive with the area defined by the second sides, is attached in contiguity with the webs and bags to the studs. The bags may be deflated to form a compact layer with the webs, which is rolled into a cylinder for transportation and storage. The cylinder is unrolled against the second sides, with the bags volumetrically expanding to fill the spaces between the studs. The second plastic sheet is then attached to the studs over the bag-web insulating combination.

6 Claims, 6 Drawing Figures

FIG. 1
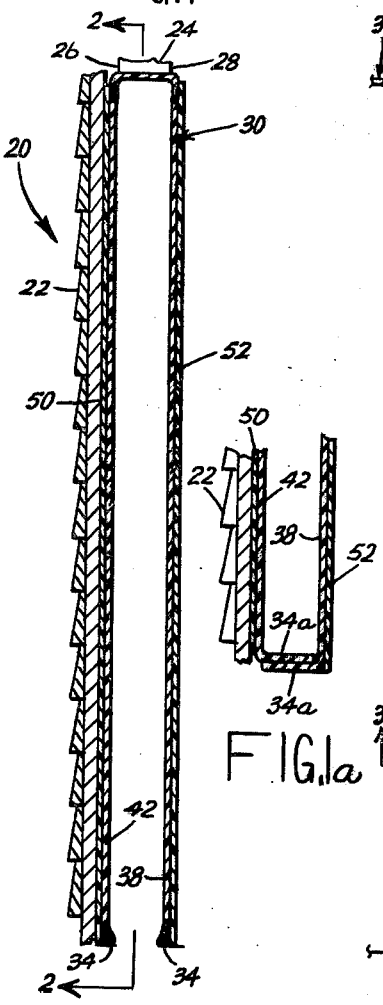
FIG. 1a
FIG. 2
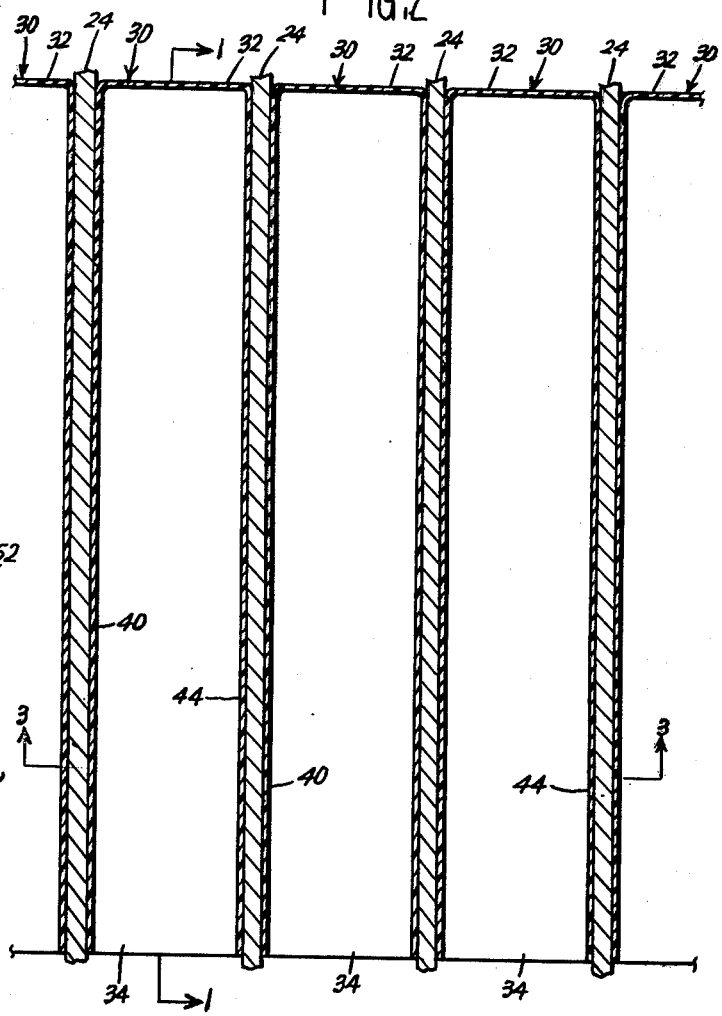
FIG. 4
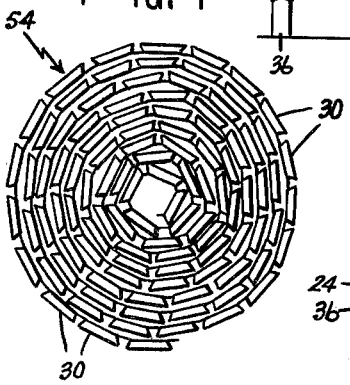
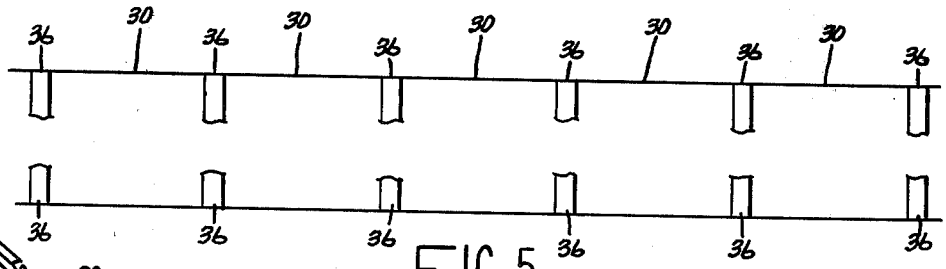
FIG. 5
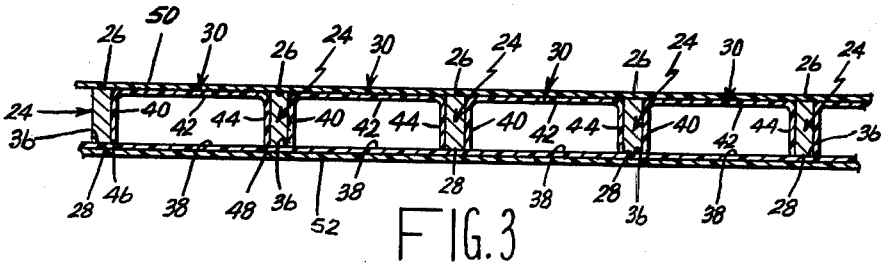
FIG. 3

BUILDING INSULATION AND METHOD OF INSTALLATION

BACKGROUND OF THE INVENTION

1. Field of the Invention

This invention is in the field of building insulation and more particularly to insulation that is installed during building construction.

2. Description of the Prior Art

Over the years, numerous efforts have been made to insulate building walls, ceilings, floors, and roofs not only for occupant comfort but also, especially in view of critical energy shortages, to conserve energy used in heating and cooling of the building. The soaring energy costs of recent years has placed additional emphasis and effort in devising energy saving products. Further, construction costs for buildings have grown to almost prohibitive proportions and therefore efforts to reduce costs in the method of building have been sought. It is well-known that air is an excellent insulating medium and efforts have been made to encapsulate air in building walls and the like for insulation purposes. These efforts have included multiple panels of corrugated paper, aluminized in some instances, plastic materials, metal materials, and other materials for fitting between the studs, or rafters, in building construction. Usually, the prior efforts have involved relatively complex and expensive materials, fabrications, and methods of installation and are exemplified by the following U.S. Pat. Nos. 2,749,262; 2,777,786; 1,913,312; 2,971,616; 2,906,655; 2,934,465; 2,955,063. Such prior methods and fabrications have not been universally accepted due in large part to their costs and complexity.

SUMMARY OF THE INVENTION

Conventional building constructions have an outer wall which is supported by inwardly placed vertical, parallel studs which are transversely spaced from one another. The studs have a first side which is substantially parallel to the wall and which sides are coplanar. The studs also have a second side spaced inwardly from and parallel to the first sides, with the second sides being coplanar. Insulating spaces are defined between adjacent studs and the planes of the first and second sides. A first sheet of heavy plastic, such as a commonly used and available plastic sold under the trademark "Visqueen", is attached to the first sides of the studs and is substantially coextensive with the plane area defined by the studs. A plurality of elongated plastic bags, made of a heavy resilient plastic material, are dimensioned to conform to the insulating spaces between the studs. Adjacent bags are connected by elongated plastic webs with each web being substantially coextensive with the stud second side. The bags are collapsible so that the bag-web combination may be rolled into a relatively compact cylinder. The cylinder is placed against an end stud so that the bags are registrable with the spaces between the studs and the webs are registrable with the second sides of the studs. The bags are resiliently and volumetrically expandable to substantially fully occupy their respective spaces between adjacent studs as the cylinder is unrolled against the second sides and the webs are successively placed against their respective stud sides. The webs are then attached, as by stapling, to the studs and a second plastic sheet, of material similar to the first plastic sheet, and coextensive with the plane area defined by the studs, is attached to the studs over the bag-web combination as by stapling to the studs. Thus, a superior insulation utilizing air as the insulating medium and utilizing a relatively inexpensive insulation fabrication and method of insulation installation is provided.

The bags may be open at the lower ends to provide air entrance during bag expansion and to further provide an outlet for gravity flow of any moisture condensation taking place on the interior surfaces of the bag due to temperature differentials. The bags may, after installation, be sealed at their lower ends.

It is therefore an object of this invention to provide a relatively inexpensive insulation fabrication and method of installation.

It is a further object to provide in such insulation the use of air as the insulating medium.

A still further object of this invention is to provide a plurality of elongated, web connected plastic bags which may be collapsed and rollable into a relatively compact cylinder and which may be unrolled against conventional housing wall, ceiling and floor frame constructions.

Another object of this invention is to provide insulation wherein moisture condensation is drainable from the surfaces of the air-encapsulating material.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a partial, sectioned side elevational view of a preferred embodiment of this invention taken at 1—1 of FIG. 2;

FIG. 1*a* is a partial, sectioned side elevational view of a second embodiment having the lower bag ends sealed;

FIG. 2 is a partial, sectioned side elevational view taken at 2—2 of FIG. 1;

FIG. 3 is a section taken at 3—3 of FIG. 2;

FIG. 4 is an end view of the insulation fabrication rolled into a cylinder; and FIG. 5 is a broken, partial view of the insulation of FIG. 4 in unrolled position.

DESCRIPTION OF THE PREFERRED EMBODIMENT

Referring to the drawing, a building construction wall 20 has outer wall 22, which is shown of wood frame construction but which may be brick, block, or other conventional outer construction, and a plurality of vertical, parallel, transversely spaced studs 24 which are attached at their upper and lower ends by a top plate and a bottom plate, respectively, not shown. Each stud 24 has a first side 26 spaced inwardly from wall 22, with sides 26 being substantially coplanar. Each stud 24 has a second side 28, spaced inwardly from first sides 26, by a distance equal to the depth of stud 24, typically 3½ inches, with sides 28 being coplanar.

A plurality of elongated plastic bags 30 made of an impervious material, such as heavy gauge plastic, which are closed at their upper ends 32 and are open at their lower ends 34 for purposes later described. Adjacent bags 30 are connected by elongated webs 36, also made of a heavy gauge impervious material.

Referring to FIG. 3, webs 36 and walls 38 of respective bags 30 may be integrally formed into a single sheet of plastic, with walls 40, 42 and 44 of each bag 30 being formed of a second plastic section which may be molded at edges 46 and 48, or otherwise hermetically attached, to wall 38. Preferably, the plastic material is of a sufficient gauge to afford resiliency to the bag so that it will assume its expanded position, as later explained.

A first heavy gauge sheet 50 of impervious material, which may be that material sold under the trademark "Visqueen", is attached, as by stapling, to the first sides 26 of studs 24. Sheet 50 is coextensive with the plane area defined between the first and last studs 24 in a wall section, completely covering the section. The installation of sheet 50 is preferably done before the erection of siding 22. A second sheet 52 of impervious material similar to that for sheet 50 is, after bags 30 have been installed between studs 24, in a manner hereinafter described, is attached to second sides 28 as by stapling, through webs 36. Sheet 52 is coextensive with the plane area defined by the first through the last studs 24 in a wall section.

The bag 30-web 36 combination may be compressed by forcing wall 42 against wall 38 in each bag 30 and forming a "jellyroll" cylinder, FIG. 4, with the bags 30 being on the outer circumference, for reasons next explained. The bag 30-web 36 combination is shown in unrolled form in FIG. 5. In the method of installation, sheet 50 is first installed by attaching to sides 26 of studs 24, as by stapling or any other conventional attaching method. Then the roll, or cylinder 54 is aligned longitudinally with the studs 24 and the pockets 30 aligned with the spaces between studs 24 and cylinder 54 is unrolled with successive bags 30 fitting into the respective spaces defined between adjacent studs 24, the plane of first sides 26, and the plane of second sides 28. The pocket width in the transverse dimension is slightly larger than the transverse spacing between studs 24 and, with the natural resiliency of the bag 30 material, the bag 30 will volumetrically expand to substantially completely occupy the aforementioned space. Ambient air is drawn through the opening 34 at the lower end of each bag to substantially completely fill each bag during the volumetric expansion. After each of the spaces in a wall section have been filled with a bag 30, the roll 54 may be trimmed and the webs 36 may be attached to their respective sides 28 as by stapling or other conventional attachment methods. After installation of the bags 30, a second sheet 52, coextensive in area with the plane area defined between the end studs in a wall section, is attached to sides 28 of the studs, through the webs 36 as by stapling or other conventional attachment methods. Thus installed, insulation is provided by a first impervious sheet 50, air entrapment bags 30, and a second sheet of plastic 52 to provide an efficient insulation construction, utilizing ambient air as the primary insulation medium, which is relatively inexpensive to manufacture and install. Due to the openings 34 at the lower end of each bag any condensation formed on the inner walls of the bag will be drained and thus moisture collection in the bags is minimized. However, as shown in FIG. 1*a*, the bags, alternatively, may be sealed at their lower ends as by rolling the ends 34*a* of walls 38, 42 together and stapling to a stud spacer or by effecting a thermoseal between the walls with a heating gun, commercially available and well known in the art.

While there have been described above the principles of this invention in connection with specific apparatus, it is to be clearly understood that this description is made only by way of example and not as a limitation to the scope of the invention.

What is claimed is:

1. In a building construction having an outer wall, a plurality of vertical, transversely spaced parallel studs each having a first side substantially parallel to and in adjacent proximity to said outer wall, said sides being substantially coplanar, and each stud having a second side spaced inwardly from said first sides, said second sides being substantially coplanar, an insulating space being defined between adjacent studs and the planes of said first and second sides, that improvement comprising;

a first plastic sheet substantially coextensive with the area defined by said first sides and adjacently supported to said first sides;

a plurality of elongated plastic bags, each insertable between adjacent studs and each bag volumetrically expandable to substantially fully occupy its respective space between the adjacent studs;

an elongated web connecting adjacent bags and said webs being substantially coextensive with said second sides and contiguous therewith; and a second plastic sheet substantially coextensive with the area defined by said second sides being adjacently supported to said webs.

2. The apparatus of claim 1 wherein said bags are open at their respective lower ends.

3. The apparatus of claim 1 wherein said web-connected bags are compressible into a substantially flat layer and said layer compactly rollable into a cylinder for transport and storage.

4. The method of insulating a building having an outer wall, a plurality of vertical, transversely spaced parallel studs each having a first side substantially parallel to and in adjacent proximity to said outer wall, said sides being substantially coplanar, and each stud having a second side spaced inwardly from said first sides, said second sides being substantially coplanar, an insulating space being defined between adjacent studs and the planes of said first and second sides; a first plastic sheet substantially coextensive with the area defined by said first sides; an elongated web connecting adjacent bags and said webs being substantially coextensive with said second sides; a second plastic sheet substantially coextensive with the area defined by said second sides comprising the steps of:

attaching said first plastic sheet in contiguity with said first sides;

unrolling a cylinder of web connected bags against said second sides so that said bags volumetrically fill said spaces and said webs are in contiguity with said second sides;

attaching at least some of said webs to said second sides; and attaching said second plastic sheet to said webs and said studs.

5. The apparatus of claim 1 wherein said bags are closed at their lower ends.

6. The method of claim 4 including the step of sealing the bags after the bags have volumetrically filled said spaces.

* * * * *